United States Patent [19]

Haines

[11] 4,444,239

[45] Apr. 24, 1984

[54] VENETIAN BLIND AND FRAME FOR VEHICLES

[76] Inventor: Richard K. Haines, 2317 W. Lexington, Elkhart, Ind. 46515

[21] Appl. No.: 462,414

[22] Filed: Jan. 31, 1983

Related U.S. Application Data

[63] Continuation-in-part of Ser. No. 326,767, Dec. 2, 1981, abandoned.

[51] Int. Cl.[3] ..... E06B 3/32

[52] U.S. Cl. ..... 160/107

[58] Field of Search ..... 160/107, 178 R, 236, 160/323–326

[56] References Cited

U.S. PATENT DOCUMENTS

| | | | |
|---|---|---|---|
| 762,330 | 6/1904 | Mansell | 160/236 |
| 2,520,524 | 8/1950 | Bretz, Jr. | 160/107 |
| 2,901,035 | 8/1959 | Anderle | 160/178 R |
| 3,151,665 | 10/1964 | Stack | 160/236 |
| 3,265,117 | 8/1966 | Lorentzen et al. | 160/174 |
| 3,818,969 | 6/1974 | Debs | 160/168 |

*Primary Examiner*—Peter M. Caun

*Attorney, Agent, or Firm*—Eugene C. Knoblock

[57] ABSTRACT

A venetian blind and frame unit for vehicles, such as vans, wherein the frame conforms to the shape or curvature of the vehicle wall. The blind is secured within the frame at upper and lower headers thereof and is tensioned so as to substantially conform to the angle of upward and inward inclination of the vehicle side wall. One of the headers includes a projecting pintle which is retractable to permit placement of the header pintles within openings in the frame. The lower header is releasably secured to the lower end of the frame to allow raising of the blind within the frame.

6 Claims, 9 Drawing Figures

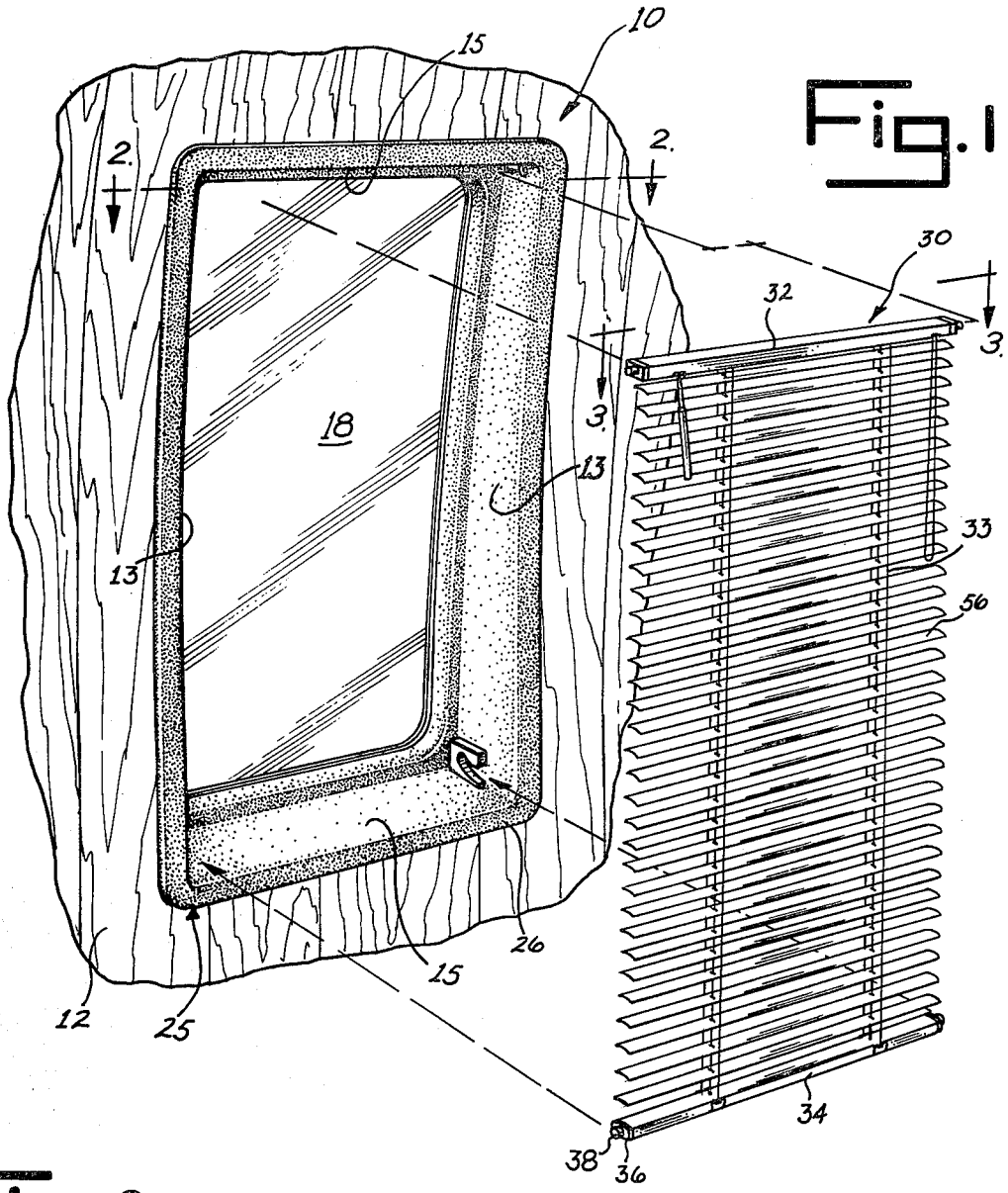
Fig. 1
Fig. 2
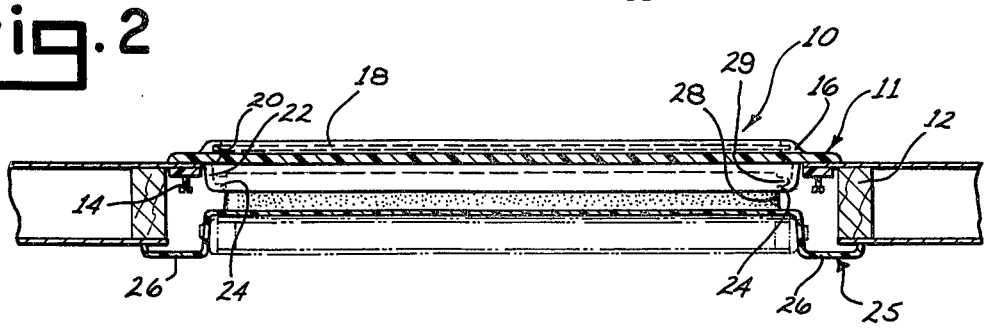
Fig. 3
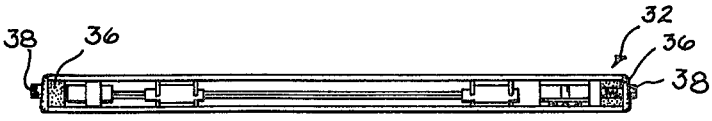

VENETIAN BLIND AND FRAME FOR VEHICLES

CROSS-REFERENCE TO RELATED APPLICATIONS

This application is a continuation-in-part of my prior filed U.S. Pat. application Ser. No. 326,767, filed Dec. 2, 1981, now abandoned.

SUMMARY OF THE INVENTION

This invention relates to a venetian blind and frame unit for vehicles, such as vans, and more specifically to a construction so mounting a venetian blind within a frame unit that the venetian blind will be confined within a frame which substantially conforms to the shape or curvature of the vehicle wall surrounding the window.

The frame unit of this invention includes an inner frame member having an outwardly extending trim flange adapted to bear against the vehicle wall surrounding a window opening, integral walls substantially perpendicular to the trim flange which fit within the window opening of the vehicle, and an inwardly projecting marginal flange perpendicular to the last named frame walls. The flanges and walls are integral with each other and define a blind receiving recess which conforms to the shape and upward and inward inclination of the vehicle wall surrounding the window opening. Spaced blind-supporting openings are provided in the side walls of the frame at its upper end. The frame recess side walls also include blind-positioning sockets at their lower portions.

The venetian blind includes upper and lower horizontal headers which substantially span the frame recess. The upper header includes a cap at each end which has a projecting pintle. One of such pintles is retractable within the cap to allow placement of the header within the frame with the pintles fitting in the openings in the frame walls. The lower header also includes an end cap at each end which has a pintle projecting therefrom. Each pintle of the lower header fits within a socket in the lower portion of the frame side walls, and is retained therein by the configuration of the socket.

The blind includes parallel slats which substantially span the frame recess horizontally and are supported within the frame by members tensioned between the upper and lower headers. When the window frame is placed within a vehicle wall which is upwardly and inwardly inclined, and the venetian blind is placed with its upper header pintles in the blind-supporting openings at the upper end of the frame and the lower header pintles are placed within the sockets at the lower end of the frame, the tensioning members support the slats within the upward and inward inclination of the window frame. Thus, the tensioning members prevent the slats from sagging downwardly and inwardly away from the window frame, and the sockets at the lower end of the frame prevent the lower header from hanging vertically downwardly from the upper header. The sockets in the lower end of the frame also permit the removal of the lower header from the sockets. The construction of the window frame and the blind is such that when the lower header is removed from the sockets, the lower header may be retracted upwardly toward the upper header, thus removing the blind from its view restricting position within the window frame.

It is an object of this invention to provide a venetian blind and window frame for a vehicle such as a van wherein the blind may be easily installed within the frame.

Another object is to provide a venetian blind and frame unit for a vehicle wherein the blind is retained within the frame unit when the frame substantially conforms to the shape of the vehicle wall which inclines upwardly and inwardly.

Another object is to provide a venetian blind and frame unit for a vehicle having upper header pintles, one pintle being retractable to facilitate mounting of the blind within the frame.

Another object is to provide a venetian blind and window frame unit for a vehicle wherein the blind includes a lower header having pintles projecting from each end thereof and each fitting and retained within a socket in the lower portion of the frame.

Yet another object is to provide a venetian blind and window frame unit for a vehicle wherein a tensioning member extends between an upper header and a lower header of the blind to retain pintles on the lower header within a socket on a frame and yet allows for removal of the lower header from the frame sockets and retraction of the lower header upwardly toward the upper header.

Another object is to provide a venetian blind and window frame unit for a vehicle wherein the frame allows easy removal of the blind lower header from securement in the frame and retraction of the lower header upwardly toward the upper header.

Other objects of this invention will become apparent upon a reading of the following description.

BRIEF DESCRIPTION OF THE DRAWINGS

FIG. 1 is a perspective exploded view of the window frame unit and venetian blind.

FIG. 2 is a sectional view taken along line 2—2 of FIG. 1 with the upper header of the blind shown in phantom.

FIG. 3 is a view taken along line 3—3 of FIG. 1.

DESCRIPTION OF THE PREFERRED EMBODIMENT

The preferred embodiment illustrated is not intended to be exhaustive or to limit the invention to the precise form disclosed. It is chosen and described in order to explain the principles of the invention and its application and practical use to thereby enable others skilled in the art to utilize the invention.

Figure 4:
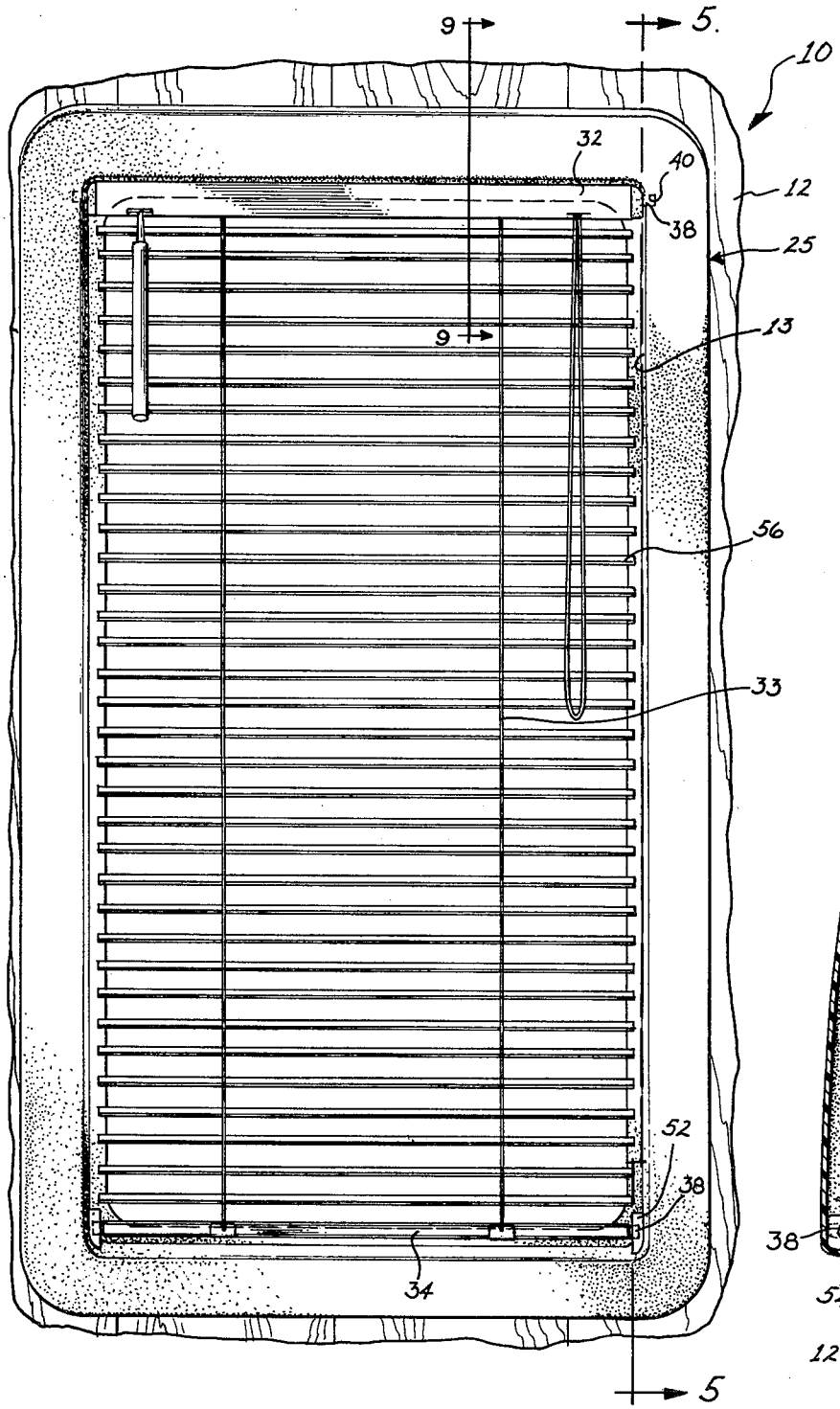
FIG. 4 is a front view of the venetian blind and frame unit.
Figure 5:
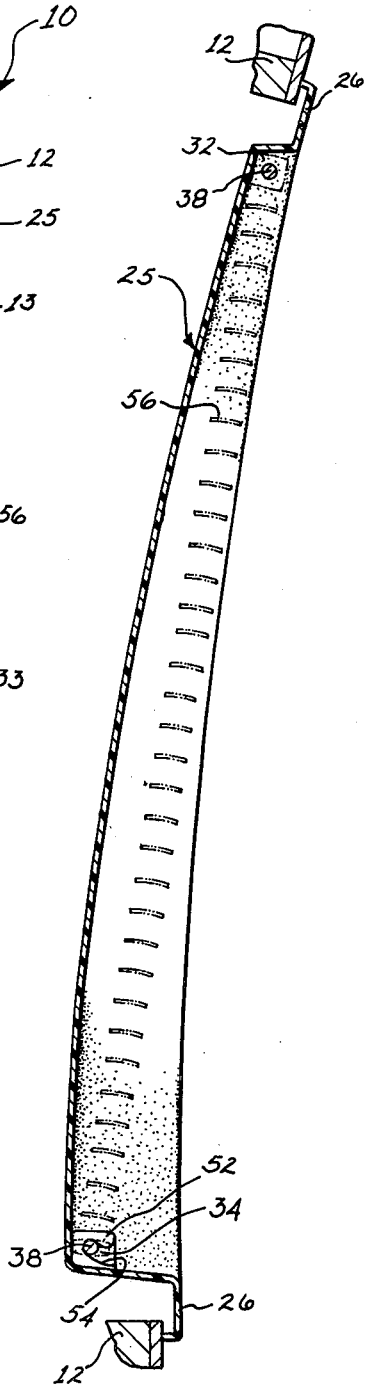
FIG. 5 is a sectional view taken along line 5—5 of FIG. 4 and showing in dotted lines the position of the slats of the blind relative to the frame.

The frame unit 10 is preferably a two-part molded plastic member which fits within a window opening of the vehicle. The window opening of the vehicle is usually formed in a wall 12 of the vehicle which has an upward and inward inclination, thus giving the space which is outlined by frame unit 10 an upward and inward inclination and curvature as shown in FIG. 5.

Frame unit 10 includes an outer trim member 11. Trim member 11 is attached to the vehicle wall 12 with bolts 14, or other fastening means, such that its outer margin 16 forms a border around the periphery of the window opening. Glazing panel 18 is fitted at its edges into grooves 20 formed in the marginal portion 16 of the trim member 11. Trim member 11 includes an inner flange portion 22 which projects into the opening in wall 12. Flange portion 22 terminates in inturned lips 24. Frame unit 10 also includes an inner trim member 25 which is anchored to trim member 11. Inner member 25 is generally rectangular and includes integrally formed longitudinally curved vertical side walls 13 and upper and lower walls 15, and conforms to the upward and inward inclination of vehicle wall 12 to provide a recess in the wall in which the blind 30 may be positioned. Side walls 13 and upper and lower walls 15 have flange portions 26 extending outwardly therefrom and abutting the inner face of vehicle wall 12. Marginal flanges 28 project inwardly from upper and lower walls 15 and side walls 13 and include parts 29 which interlock with lips 24 of trim member 11 to hold inner member 25 in place with its flange portions 26 firmly abutting vehicle wall 12.

Blind 30 includes multiple slats 56, an upper header 32 and a lower header 34, slat retaining tapes and tensioning cords 33 connecting the upper and lower headers and supporting, spacing and positioning the slats 56. Each header includes a cap 36 at each end thereof which preferably interlocks with the header in a snap fit. Each cap 36 has a pintle 38 projecting therefrom.

Figure 6:
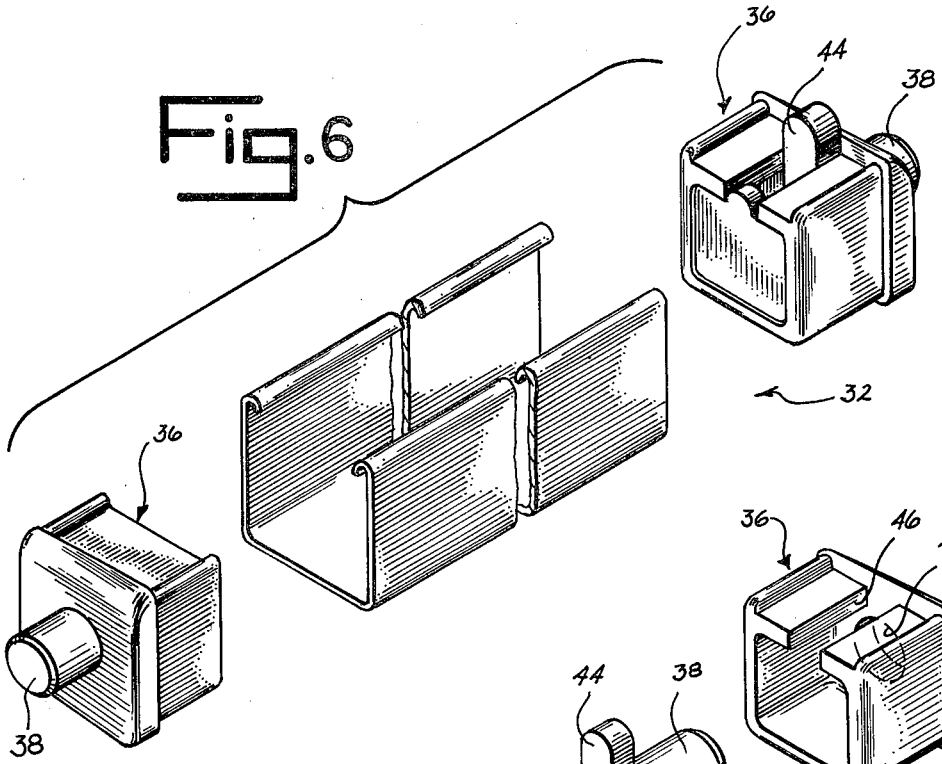
FIG. 6 is a fragmentary exploded view of the upper header of the blind.
Figure 7:
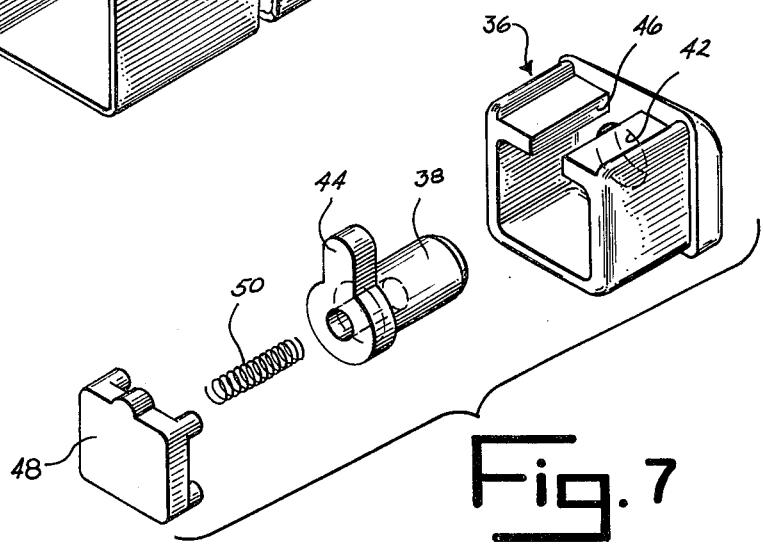
FIG. 7 is an exploded view of a header cap having a retractable pintle.
Figure 8:
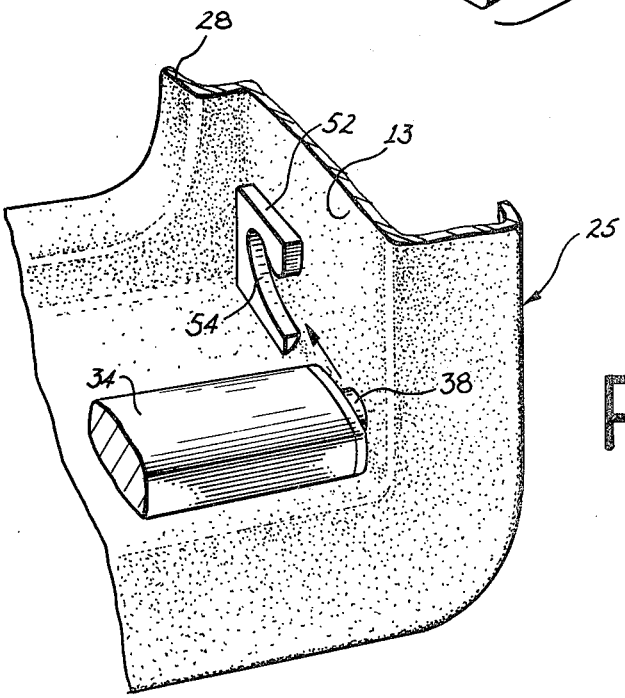
FIG. 8 a fragmentary perspective view of a lower corner of the frame unit.

Pintles 38 of upper header 32 fit within openings 40 in side walls 13 of inner frame member 25. One of the pintles 38 of upper header 32 is shiftable and spring urged so that it is retractable within cap 36, as shown in FIGS. 6 and 7. Retractable pintle 38 fits at one end within an opening 42 in cap 36 and has a projection 44 transverse to its axis which travels within a slot 46 in the body of the cap 36. An end wall 48 is mounted in cap 36 to close slot 46 and retain pintle 38 within cap 36. A coil spring 50 is positioned and is compressed between pintle 38 and end wall 48 to force pintle 38 into opening 40 of frame side wall 13 when it is aligned with the opening. Such a construction enables easy installation and removal of blind 30 such as by manual retraction of pintle 38 within cap 36 when installation of upper header 32 is desired.

Figure 9:
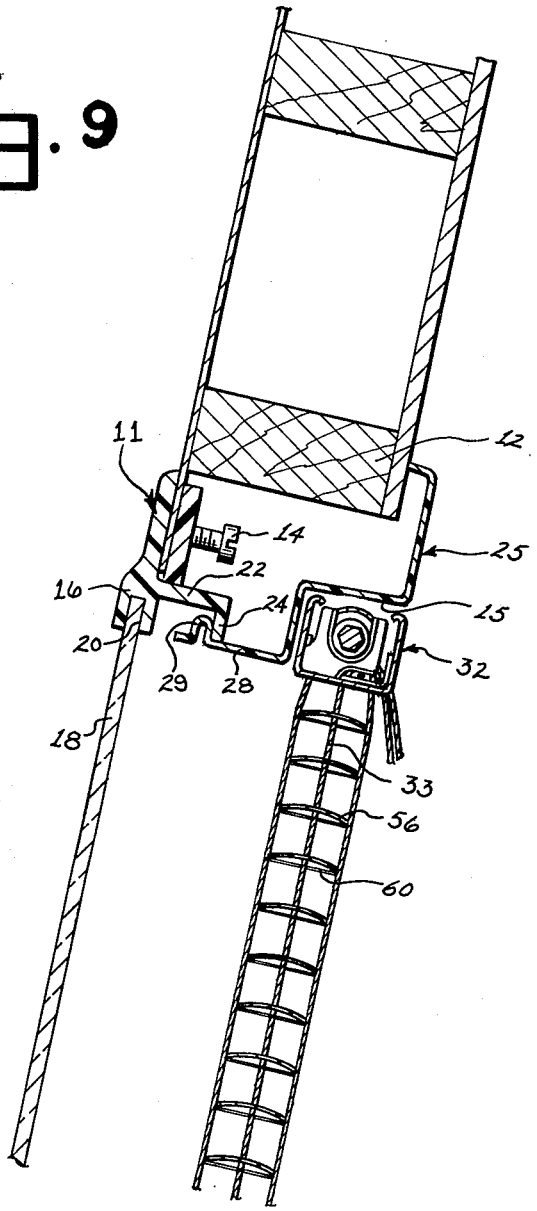
FIG. 9 is a fragmentary sectional view taken along line 9 of FIG. 4.

The lower end of each frame side wall 13 includes a socket 52 having an open ended upwardly curving groove 54 for receiving pintle 38 of lower header 34 as illustrated in FIG. 5. The upward curve of grooves 54 and the tension of cords 33 serve to lock lower pintles 38 within the grooves 54, thereby holding the lower end of blind 30 within the outline of inner member 25 when frame unit 10 is installed in a vehicle wall having an upward and inward slant as seen in FIG. 5. When so installed, slats 56 of blind 30 lie in a parallel horizontal relationship and are spaced apart along tensioned flexible suspension cords 33 and are supported therebetween by threads 60. The tension cords 33 are of a length to be taut to position the slats 56 in inclined vertical alignment with all slats within the space between frame side walls 13 as seen in FIGS. 5 and 9, when the headers are anchored to the frame. Cords 33 are extensible sufficiently to permit insertion of pintles 38 of the lower header into the grooves 54 of sockets 52 to install the venetian blind. Grooves 54 of sockets 52 also permit release of pintles 38 of the lower header from the frame so that the blind 30 will hang vertically from upper header 32. When the blind hangs vertically with its lower header released from the frame, it may be collapsed by actuating the tensioning cords 33 to draw the lower header 34 upwardly toward upper header 32. This is also made possible by the fact that tensioning cords 33 and slat retaining tapes are attached at their ends to upper header 32 and lower header 34, so that the tapes are collapsible with the blind 30. It should be understood that the securement of lower header 34 to frame unit 10 need not necessarily be accomplished with a socket and groove construction which receive the pintles 38 of the lower header, but may also be accomplished in a manner similar to that of the securement of upper header 32 to the frame unit with retractable header pintles which fit into openings formed in the frame side walls 13.

It is to be understood that the invention is not to be limited by the terms of the above description, but may be modified within the scope of the appended claims.

I claim:

1. In combination, an upwardly and inwardly inclined window frame mounted in and having walls lining a motor vehicle window opening formed in an upwardly and inwardly curved vehicle wall, and a venetian blind fitting in said frame with clearance and having upper and lower headers with projecting end pintles, a plurality of spaced horizontal slats, slat supports and tension means connected to and extending between said headers for pulling toward each other said headers and tensioning said slat supports, said frame having upper openings for receiving the end pintles of said upper header, and rigid socket means at a lower portion of said frame having grooves for releasably receiving the pintles of said lower header, said tension means retaining said lower header pintles in locking engagement in said grooves and positioning said slats within the upwardly and inwardly inclined space outlined by said frame walls, whereby said tensioning means serve the dual purpose of positioning said slats within the outline of the window frame when said lower header pintles are locked in said grooves and of collapsing said blind vertically when said lower header pintles are released from said grooves.

2. The combination of claim 1 wherein one of said upper header pintles normally projects from said upper header into a frame opening and is retractable into said upper header for release from said frame opening.

3. The combination of claim 1 wherein said frame includes a section having an outer flange which bears against one surface of said vehicle wall, inwardly extending walls connected to said flange and lining said vehicle window opening, a second frame section connected to said inwardly extending walls of said first frame section and bearing against the opposite surface of said vehicle wall around said vehicle window opening, said inwardly extending walls including spaced vertical walls and spaced horizontal walls which outline a space for receiving said blind, said vertical walls being curved upwardly and inwardly, said frame upper openings formed in an upper portion of said vertical walls, and said rigid socket means being formed at a lower portion of said vertical walls.

4. The combination of claim 1, wherein said sockets constitute open ended grooves curved upwardly from their open ends.

5. The combination of claim 1, wherein said retractable pintle is contained within a cap carried by an end of said upper header, said cap having a slot substantially parallel to said header and an opening in an outer cap end wall through which said pintle projects, an abutment in said cap, and spring means within said cap compressed between said pintle and said abutment, said pintle having a projection extending through said slot whereby said pintle may be manually retracted against the action of said spring.

6. The combination of claim 3 wherein said rigid socket means are integrally formed in a lower portion of said window frame vertical walls.

* * * * *